US006510825B2

(12) United States Patent
Cristiani et al.

(10) Patent No.: US 6,510,825 B2
(45) Date of Patent: Jan. 28, 2003

(54) INTERNAL COMBUSTION ENGINE FOR MOTOR VEHICLES AND THE LIKE

(75) Inventors: Marcello Cristiani, Imola (IT); Nicola Morelli, Rende (IT)

(73) Assignee: Magneti Marelli Powertrain S.p.A., Turin (IT)

( * ) Notice: Subject to any disclaimer, the term of this patent is extended or adjusted under 35 U.S.C. 154(b) by 0 days.

(21) Appl. No.: 09/960,478

(22) Filed: Sep. 24, 2001

(65) Prior Publication Data

US 2002/0035975 A1 Mar. 28, 2002

(30) Foreign Application Priority Data

Sep. 22, 2000 (IT) ..... BO2000A000548

(51) Int. Cl.[7] ..... F01L 9/02

(52) U.S. Cl. ..... 123/90.12; 123/90.13; 123/90.15; 123/90.55; 123/90.56; 251/12; 251/14; 251/129.03

(58) Field of Search ..... 123/90.12, 90.13, 123/90.15, 90.55, 90.56; 251/12, 14, 129.03

(56) References Cited

U.S. PATENT DOCUMENTS 4,930,464 A * 6/1990 Letsche ..... 123/90.12
6,024,060 A * 2/2000 Buehrle et al. ..... 123/90.11
6,308,690 B1 * 10/2001 Sturman ..... 123/447
6,321,703 B1 * 11/2001 Diehl et al. ..... 123/90.12
6,349,686 B1 * 2/2002 Feucht et al. ..... 123/446
6,415,752 B1 * 7/2002 Janak ..... 123/90.12

FOREIGN PATENT DOCUMENTS

DE 44 07 585 A1 9/1995
WO 93/01399 A1 1/1993

OTHER PUBLICATIONS

Kenichiro, "Valve Driving Device", Patent Abstracts of Japan, No. 62–12921, vol. 018, No. 579, (M–1698), Nov. 7, 1994.

* cited by examiner

*Primary Examiner*—Thomas Denion
*Assistant Examiner*—Ching Chang
(74) *Attorney, Agent, or Firm*—Robert Kinberg; Venable, LLP

(57) ABSTRACT

An internal combustion engine comprising at least one intake valve and/or exhaust valve moving axially between a closed position and a position of maximum opening and means for moving the valves adapted to move, on command, this valve between the closed position and the position of maximum opening, the valve movement means comprising an elastic member adapted to maintain this valve in the closed position, a hydraulic actuator selectively adapted to move this valve from the closed position to the position of maximum opening by countering the action of the elastic member, and a hydraulic circuit adapted to supply pressurized fluid to the hydraulic actuator, the hydraulic circuit comprising a delivery duct connected to the hydraulic actuator and pumping means adapted to supply pressurized fluid into the delivery duct, the pumping means comprising the elastic member and the hydraulic actuator.

5 Claims, 3 Drawing Sheets

$F_M$
$F_e$
$F_o$
t

OPEN
CLOSED
t

OPEN
CLOSED
t mm
t

INTERNAL COMBUSTION ENGINE FOR MOTOR VEHICLES AND THE LIKE

The present invention relates to an internal combustion engine for motor vehicles and the like.

BACKGROUND OF THE INVENTION

As is known, internal combustion engines are currently being tested in which the intake and exhaust valves that selectively bring the combustion chamber of the engine into communication with the intake manifold and the exhaust manifold respectively of the engine are actuated by electromagnetic actuators driven by an electronic control unit. This solution makes it possible to vary the opening and closing moments of the valves in a very precise manner as a function of the angular speed of the crankshaft and of other operating parameters of the engine, substantially increasing the performance of the engine.

The electromagnetic actuator that currently provides the best performance is disposed alongside the stem of the valve of the internal combustion engine to be axially moved and comprises a support frame secured to the head of the internal combustion engine, an oscillating arm of ferromagnetic material having a first end hinged on the support frame in order to be able to oscillate about an axis of rotation perpendicular to the longitudinal axis of the valve, and a second end shaped as a curved finger disposed in abutment on the upper end of the stem of the valve, and a pair of electromagnets disposed on opposite sides of the central portion of the oscillating arm in order to be able to attract, on command and alternatively, the oscillating arm by causing it to rotate about its axis of rotation.

The electromagnetic actuator lastly comprises two elastic members, the first of which is adapted to maintain the valve of the engine in a closed position and the second of which is adapted to maintain the oscillating arm in a position such as to maintain this valve in the position of maximum opening. The two elastic members act in opposition against one another and are dimensioned such as to position, when both electromagnets are deactivated, i.e. in a condition of equilibrium, the oscillating arm in a rest position in which it is substantially equidistant from the polar heads of the two electromagnets so as to maintain the engine valve in an intermediate position between the closed position and the position of maximum opening.

Unfortunately, the electromagnetic actuators described above operate well, i.e. are able to ensure the full opening and closing of the intake and exhaust valves of the engine, only when the engine is operating at a relatively low speed of rotation. Experimental tests have shown a substantial deterioration of the engine performance at speeds of rotation higher than 6000 rpm that can be directly attributed to the malfunction of the electromagnetic actuators. This structural drawback is obviously incompatible with the maximum speeds of rotation achieved by internal combustion engines of small and medium cubic capacity that are currently commercially available.

In order to remedy the drawbacks described above, tests have recently started on internal combustion engines in which the intake and exhaust valves of the engine are moved by means of electro-hydraulic actuations which are obviously also driven by an electronic control unit.

Tests are in particular being conducted on internal combustion engines which comprise, for each intake or exhaust valve of the engine, a linear hydraulic actuator adapted axially to displace the corresponding valve from the closed position to the position of maximum opening by overcoming the action of an elastic member adapted to maintain this valve in the closed position, and an electrically controlled hydraulic distributor adapted to regulate the flow of pressurised oil to and from the hydraulic actuator so as to cause the valve to be displaced between the closed position and the position of maximum opening.

In order to meet the demand for pressurised oil, the internal combustion engines being tested are further provided with a hydraulic circuit which comprises an oil collection tank in which the oil to be supplied to the actuators is stored at ambient pressure and a pumping unit adapted to supply pressurised oil to the various hydraulic distributors by taking it directly from the collection tank.

Each electrically controlled hydraulic distributor is connected to the hydraulic circuit so that it can bring the corresponding linear hydraulic actuator into direct communication respectively with the delivery outlet of the pumping unit when it is necessary to displace the valve from the closed position to the open position, and with the collection tank when it is necessary to displace the valve from the open position to the closed position. In the former case, the pressurised oil is caused to flow into the linear hydraulic actuator. In the latter case, the pressurised oil filling the linear hydraulic actuator is caused to flow directly into the collection tank.

In other words, therefore, all the pressurised oil supplied to the hydraulic actuator during the displacement of the valve from the closed position to the position of maximum opening, is discharged directly into the collection tank during the displacement of the valve from the position of maximum opening to the closed position under the action of the elastic member adapted to maintain this valve in the closed position.

The main drawback of the solution using electro-hydraulic actuators described above is that the pressurised oil demand is particularly high and, moreover, increases proportionally with the number of revolutions of the engine and requires the use of pumping units that are so bulky that they are in practice incompatible with applications in the motor vehicle field.

SUMMARY OF THE INVENTION

The object of the present invention is to provide an internal combustion engine in which the electro-hydraulic actuators have a pressurised oil demand that is substantially lower than current actuators.

The present invention therefore relates to an internal combustion engine for motor vehicles and the like which comprises at least one intake and/or exhaust valve moving axially between a closed position and a position of maximum opening and means for moving the valves adapted to move, on command, at least this one valve between the closed position and the position of maximum opening, the valve movement means comprising an elastic member adapted to maintain at least this one valve in the closed position, a hydraulic actuator selectively adapted to move at least this one valve from the closed position to the position of maximum opening by countering the action of the elastic member, and a hydraulic circuit adapted to supply pressurised fluid to the hydraulic actuator, the hydraulic circuit comprising a delivery duct connected to the hydraulic actuator and pumping means adapted to supply pressurised fluid into the delivery duct, the internal combustion engine being characterised in that the pumping means comprise the elastic member and the hydraulic actuator.

BRIEF DESCRIPTION OF THE DRAWINGS

The present invention will be described below with reference to the accompanying drawings which show a non-limiting embodiment thereof and in which.

DETAILED DESCRIPTION OF THE INVENTION

Figure 1:
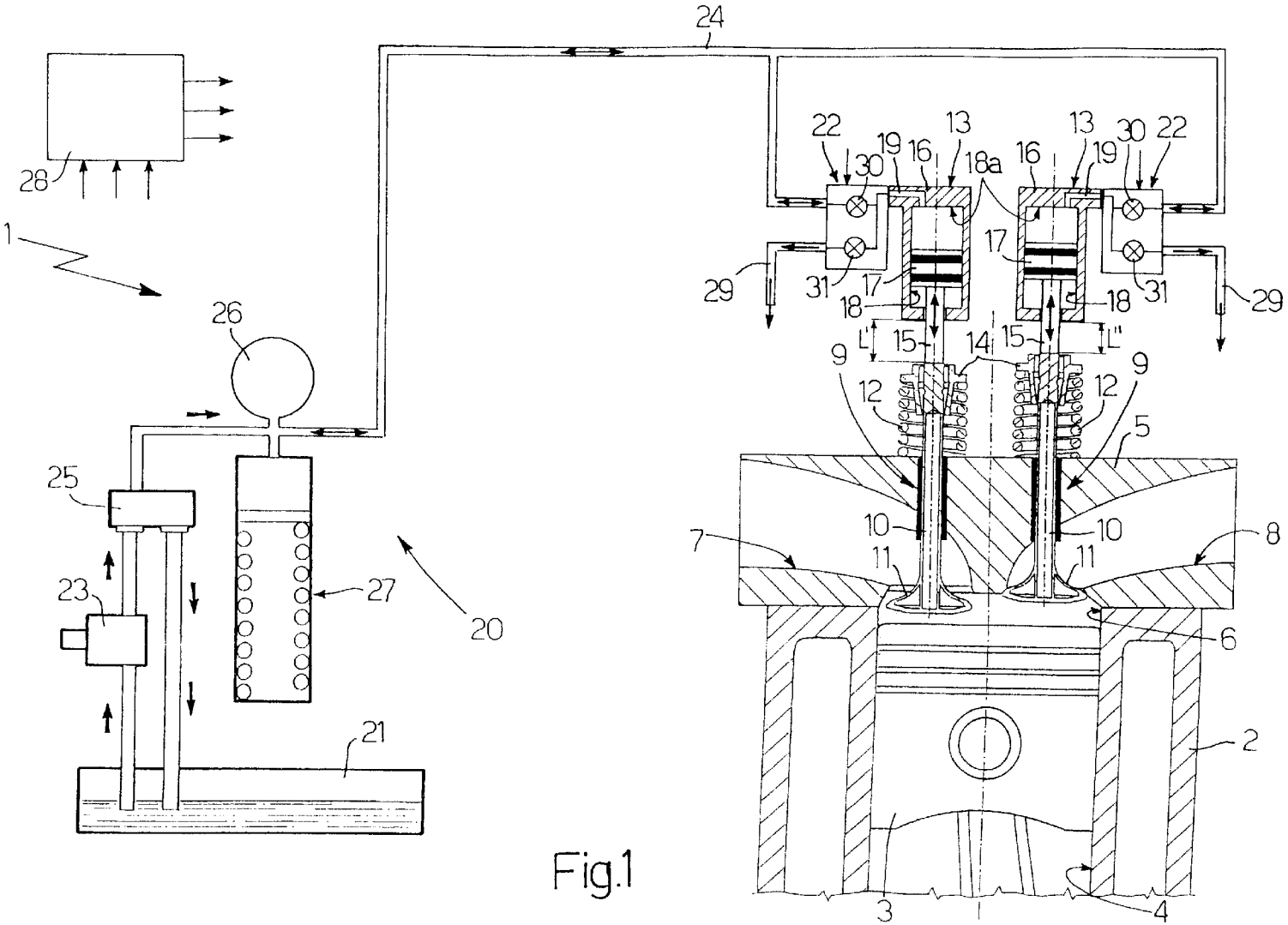
FIG. 1 is a diagram, with some parts in cross-section and some parts removed for clarity, of an internal combustion engine according to the present invention.

FIG. 1, an internal combustion engine for motor vehicles and the like is shown overall by 1 and comprises a base 2, one or a plurality of pistons 3 mounted in an axially sliding manner in respective cylindrical cavities 4 provided in the body of the base 2 and a head 5 disposed on the apex of the base 2 and closing the cylindrical cavities 4.

Together with the head 5, each piston 3 bounds, within the respective cylindrical cavity 4, a variable-volume combustion chamber 6; the head 5 is provided, for each combustion chamber 6, with at least one intake duct 7 and at least one exhaust duct 8 adapted to connect the combustion chamber respectively with the intake manifold and with the exhaust manifold of the engine 1, both of known type and not shown.

In FIG. 1, the engine 1 is lastly provided with a group of valves adapted to regulate the flow of air into the combustion chamber 6 via the intake duct 7 and the discharge of combusted gases from the combustion chamber 6 via the exhaust duct 8.

The engine 1 in particular has, at the inlet of each duct, whether it is an intake duct 7 or an exhaust duct 8, a respective mushroom valve 9 of known type which is mounted on the head 5 with its stem 10 sliding axially through the body of the head 5 and its head 11 moving axially at the inlet of this duct, so that it can move between a closed position in which the head 11 of the valve 9 prevents gases from flowing through the intake or exhaust duct 7, 8 to and from the combustion chamber 6, and a position of maximum opening in which the head 11 of the valve 9 allows gases to flow through the intake or exhaust duct 7, 8 to and from the combustion chamber 6 with the maximum admissible flow.

The valves 9 positioned at the inlet of the intake ducts 7 are normally known as "intake valves" and the valves 9 positioned at the inlet of the exhaust ducts 8 are normally known as "exhaust valves".

In FIG. 1, the engine 1 further comprises, for each intake valve 9 and/or exhaust valve 9, an elastic member 12 adapted to maintain the valve 9 in the closed position and a linear hydraulic actuator 13 adapted axially to displace the valve 9 from the closed position to the position of maximum opening by overcoming the action of the elastic member 12.

In the embodiment shown, each elastic member 12 is formed by a pre-compressed helical spring 12 keyed on the stem 10 of the valve 9 so as to have its first end in abutment on the head 5 of the engine, and its second end in abutment on an abutment flange 14 rigid with the stem 10 of the valve 9.

Each of the linear hydraulic actuators 13 is provided with an output shaft 15 which can move axially between a forward position in which it projects externally from the body 16 of the linear hydraulic actuator 13 by a predetermined length L' and a retracted position in which it projects externally from the body 16 of the linear hydraulic actuator 13 by a length L" smaller than L'.

Each linear hydraulic actuator 13 is, moreover, mounted above the corresponding valve 9 with its output shaft 15 disposed coaxial to, and in abutment on, the stem 10 of the valve 9 so as to be able axially to move the valve 9 by displacing the output shaft 15 between the forward position and the retracted position.

In this case, when the output shaft 15 is in the retracted position, the valve 9 is in the closed position, and when the output shaft 15 is in the forward position, the valve 9 is in the position of maximum opening.

In the embodiment shown, each linear hydraulic actuator 13 in particular comprises a piston 17 mounted in an axially sliding manner within a cylindrical cavity 18 obtained in the body 16 of the hydraulic actuator. The output shaft 15 of the linear hydraulic actuator 13 is coaxial with the piston 17 and has an end rigid with this piston 17, while the latter defines a variable-volume chamber 18*a* selectively adapted to be filled with pressurised oil within the cylindrical cavity 18. This pressurised oil is able to exert a force on the piston 17 sufficient axially to move this piston 17 within the cylindrical cavity 18 so as to maximise the volume of the variable-volume chamber.

As the output shaft 15 of the linear hydraulic actuator 13 is rigid with the piston 17, the displacement of this piston from the position in which the volume of the variable-volume chamber 18*a* is minimal, to the position in which the volume of the variable-volume chamber 18*a* is maximal, is reflected by the displacement of the output shaft 15 from the retracted position to the forward position.

In order to enable the pressurised oil to flow into and out of the variable-volume chamber 18*a*, each linear hydraulic actuator 13 is lastly provided with a through duct 19 which extends through the body 16 of the actuator in order to bring the variable-volume chamber 18*a* into communication with atmosphere.

With reference to FIG. 1, the engine 1 lastly comprises a hydraulic circuit 20 for the supply of pressurised oil adapted to meet the pressurised oil demand from the linear hydraulic actuators 13.

In the embodiment shown, this hydraulic circuit comprises an oil collection tank 21, in which the oil to be supplied to the linear hydraulic actuators 13 is stored at ambient pressure, a set of electronically controlled hydraulic distributors 22 each of which is adapted to regulate the flow of pressurised oil to and from a respective linear hydraulic actuator 13 and a pumping unit 23 adapted to take the oil directly from the collection tank 21 and to supply pressurised oil to the various hydraulic distributors 22 via a delivery duct 24.

In the embodiment shown, the pumping unit 23 is adapted to be driven in rotation directly by the shaft of the internal combustion engine 1.

The hydraulic circuit 20 further comprises a pressure regulator 25 disposed immediately downstream of the pumping unit 23, adapted to maintain the oil pressure within the delivery duct 24 at a predetermined value (for instance 100 bar), a collection tank 26 for the pressurised oil in which the pressurised oil flowing along the delivery duct 24 is stored and possibly a pressure peak damper 27 adapted to damp the pressure peaks that occur in the delivery duct 24 during the normal operation of the engine 1.

It should be noted that, in a different configuration, the delivery duct 24 may be dimensioned so as to accumulate a predetermined quantity of pressurised oil in its interior, acting also as a pressurised oil collection tank. In this case, therefore, the collection tank 26 is formed by the delivery duct 24.

The engine 1 lastly comprises an electronic control unit 28 adapted to drive the hydraulic distributors 22 so as to control, moment by moment, the position of the output shaft 15 of each linear hydraulic actuator 13 and therefore the position of each valve 9 of the engine.

Each of the hydraulic distributors 22 is simultaneously connected to the delivery duct 24, to the variable-volume chamber 18*a* of the corresponding linear hydraulic actuator 13 and to an exhaust duct 29 in direct communication with the oil collection tank 21, and comprises a delivery electrovalve 30 selectively adapted to bring the delivery duct 24 into communication with the variable-volume chamber 18*a* so as to enable the pressurised oil to flow into the variable-volume chamber 18*a*.

Each hydraulic distributor 22 further comprises an exhaust electrovalve 31 selectively adapted to bring the exhaust duct 29 into communication with the variable-volume chamber 18*a* so as to enable the pressurised oil contained in the variable-volume chamber 18*a* to be discharged directly into the collection tank 21.

As will be explained below, in contrast to the hydraulic supply circuits known at present, the electronic control unit 28 of the engine 1 is adapted to keep the delivery electrovalve 30 of the hydraulic distributor 22 open for at least part of the closing stroke of the corresponding valve 9, i.e. for at least part of the displacement of the valve 9 from the position of maximum opening to the closed position, so as to cause the pressurised oil contained in the variable-volume chamber 18*a* to flow back out of the linear hydraulic actuator 13 into the delivery duct 24 and/or the collection tank 26.

In other words, the electronic control unit 28 of the engine 1 uses the elastic energy accumulated in the elastic member 12 during the displacement of the valve 9 from the closed position to the position of maximum opening to convert the linear hydraulic actuator 13 that actuates the valve 9 into a pump able to urge the pressurised oil contained in the variable-volume chamber 18*a* back into the delivery duct 24 and/or the collection tank 26 of the hydraulic circuit 20.

Moreover, in contrast to known hydraulic supply circuits, the electronic control unit 28 is adapted to keep the exhaust electrovalve 31 of the hydraulic distributor 22 open only during the final part of the closing stroke of the corresponding valve 9 so as to cause only that part of the pressurised oil contained in the variable-volume chamber 18*a*, which the elastic member 12 has not been able to urge back into the delivery duct 24 and/or the collection tank 26, to flow back into the collection tank 21.

The operation of the engine 1 will now be described assuming that the valve 9 is in the closed position and therefore that the delivery electrovalve 30 is closed and the variable-volume chamber 18*a* of the linear hydraulic actuator 13 has the minimum volume and is in direct communication with the exhaust duct 29 via the exhaust electrovalve 31 which is obviously open.

When the valve 9 needs to be displaced from the closed position to the position of maximum opening, the electronic control unit 28 of the engine 1 causes the hydraulic distributor 22 to open the delivery electrovalve 30 and to close the exhaust electrovalve 31.

Figures 3, 4, 5, 6:
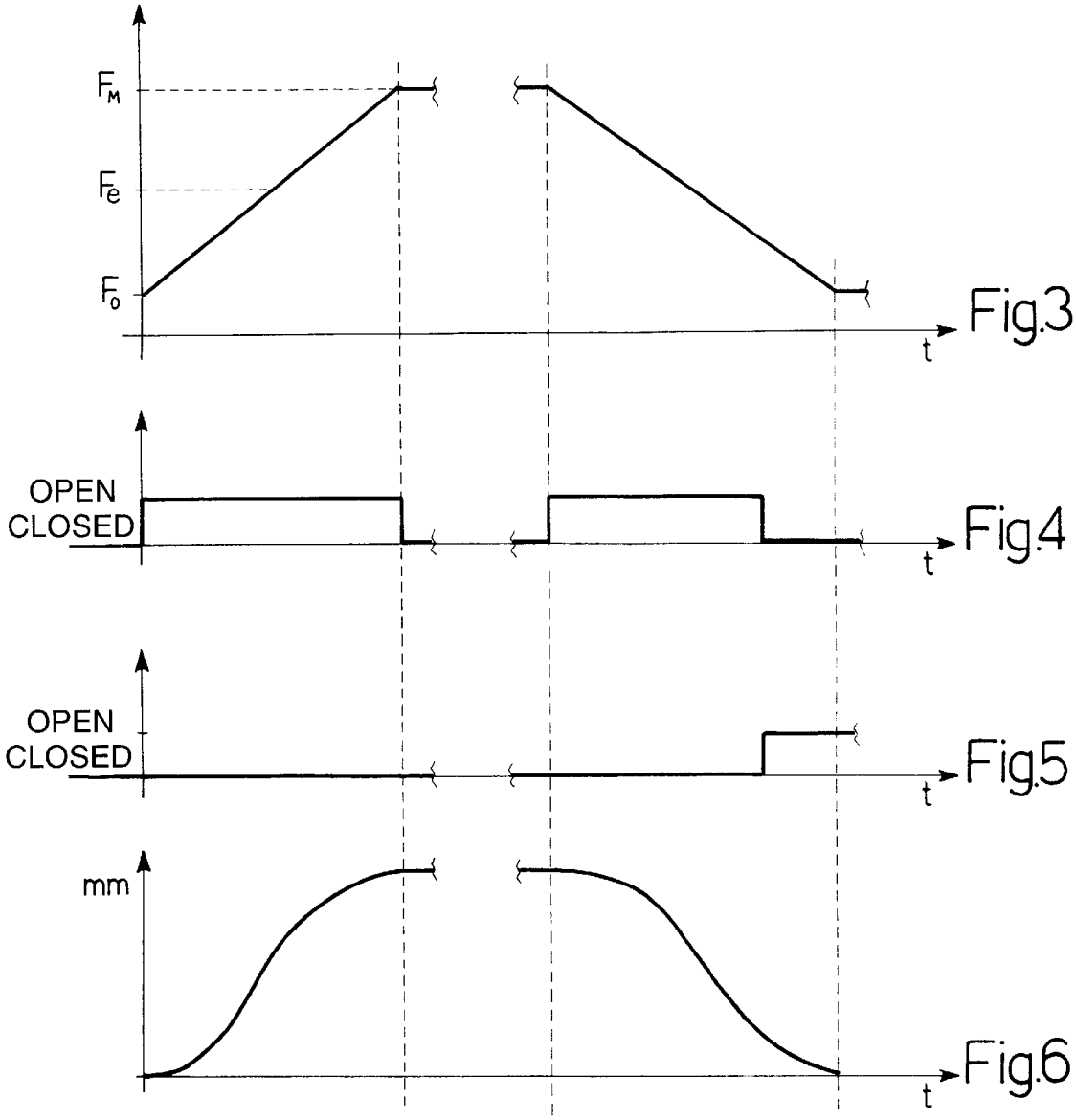
FIGS. 3, 4, 5 and 6 are graphs of the operation of the engine of FIG. 1.

With reference to FIGS. 3 and 4 which respectively show, as a function of time, the value of the axial force exerted by the elastic member 12 and the state of the delivery electrovalve 30, the opening of the delivery electrovalve 30 enables the pressurised oil to enter the variable-volume chamber 18*a* and a consequent rapid increase in the force exerted by the pressurised oil on the piston 17 of the linear hydraulic actuator 13. As soon as the force exerted by the pressurised oil exceeds the value $F_o$ exerted by the pre-compressed helical spring 12, the piston 17 starts to move, displacing the output shaft 15 of the hydraulic actuator 13 from the retracted to the forward position.

For the first half of the opening stroke of the valve 9, i.e. for the first half of the displacement of the valve 9 from the closed position to the position of maximum opening, the piston 17 gradually accelerates until the force exerted by the pressurised oil is not equal to the value $F_o$ of the force exerted by the helical spring 12.

Halfway through the opening stroke of the valve 9, the axial force exerted by the helical spring 12 is therefore balanced by the force generated by the pressurised oil acting on the piston 17. At this point, the piston 17 starts progressively to decelerate using the accumulated kinetic energy further to compress the helical spring 12.

With reference to FIG. 6, which shows the curve as a function of time of the lift of the valve 9, at the end of the opening stroke, i.e. when the output shaft 15 of the linear hydraulic actuator 13 is in the forward position and the valve 9 is in the position of maximum opening, the electronic control unit 28 of the engine 1 causes the hydraulic actuator 22 to close the delivery electrovalve 30.

At this point, as the delivery electrovalve 30 and the exhaust electrovalve 31 are both closed, the pressurised oil cannot flow in either direction, thereby blocking any displacement of the piston 17 in the cylindrical cavity 18. The valve 9 therefore remains blocked in the position of maximum opening, with the helical spring 12 exerting the maximum axial force FM on the output shaft 15 of the linear hydraulic actuator 13 and therefore on the piston 17.

When the valve 9 needs to be displaced from the position of maximum opening to the closed position, the electronic control unit 28 of the engine 1 causes the hydraulic distributor 22 to re-open the delivery electrovalve 30, keeping the exhaust electrovalve 31 closed.

As the piston 17 is subject to the force exerted by the helical spring 12 and as this force is sufficient to bring the pressure of the oil contained in the variable-volume chamber 18*a* to a value greater than that of the oil contained in the delivery duct 24, the opening of the delivery electrovalve 30 causes the pressurised oil to flow from the variable-volume chamber 18*a* to the delivery duct 24 with a consequent reduction of the force exerted by the pressurised oil on the piston 17 of the linear hydraulic actuator 13.

For the first half of the displacement of the valve 9 from the position of maximum opening to the closed position, the force exerted by the helical spring 12 is greater than the force exerted by the pressurised oil on the piston 17, as a result of which the piston 17 gradually accelerates. Approximately halfway through the closing stroke of the valve 9, the axial force exerted by the helical spring 12 is again balanced by the force generated by the pressurised oil acting on the piston 17, as a result of which the piston 17 starts gradually to decelerate using the residual kinetic energy to pump part of the pressurised oil still in the variable-volume chamber 18*a* into the delivery duct 24.

With reference to FIG. 5, which shows, as a function of time, the state of the exhaust electrovalve 31, when the helical spring 12 is no longer able to exert an axial force on the piston 17 sufficient to force the pressurised oil from the variable-volume 18*a* to the delivery duct 24, the electronic control unit 28 of the engine 1 causes the hydraulic distributor 22 to close the delivery electrovalve 30 and to open the exhaust electrovalve 31 so as to discharge the remaining part of the pressurised oil contained in the hydraulic actuator 13 directly into the collection tank 21.

At this point, the valve 9 can complete the closing stroke, discharging only that part of the pressurised oil that the mechanical losses have not made it possible to recover via the helical spring 12 into the collection tank 21.

When the valve 9 has reached the closed position, the electronic control unit 28 of the engine 1 may cause the hydraulic distributor 22 immediately to close the exhaust electrovalve 31, or to keep it open for a predetermined period of time.

In substance, therefore, in control systems for the valves of an internal combustion, the energy needed to move the valves can be divided into energy dissipated during movement and "oscillating" energy needed for the alternating movement of the valves. In the internal combustion engines known at present, all the energy needed for the movement of the valves is dissipated, while in the internal combustion engine described and illustrated here, the "oscillating" energy is recovered, increasing the overall performance of the engine.

The advantages are evident: using this solution, the pumping unit 23 has to be dimensioned to ensure a flow of pressurised oil sufficient solely to recover the very small quantity of oil discharged directly into the collection tank 21.

It will be appreciated that modifications and variations may be made to the engine 1 as described and illustrated without thereby departing from the scope of he present invention.

Figure 2:
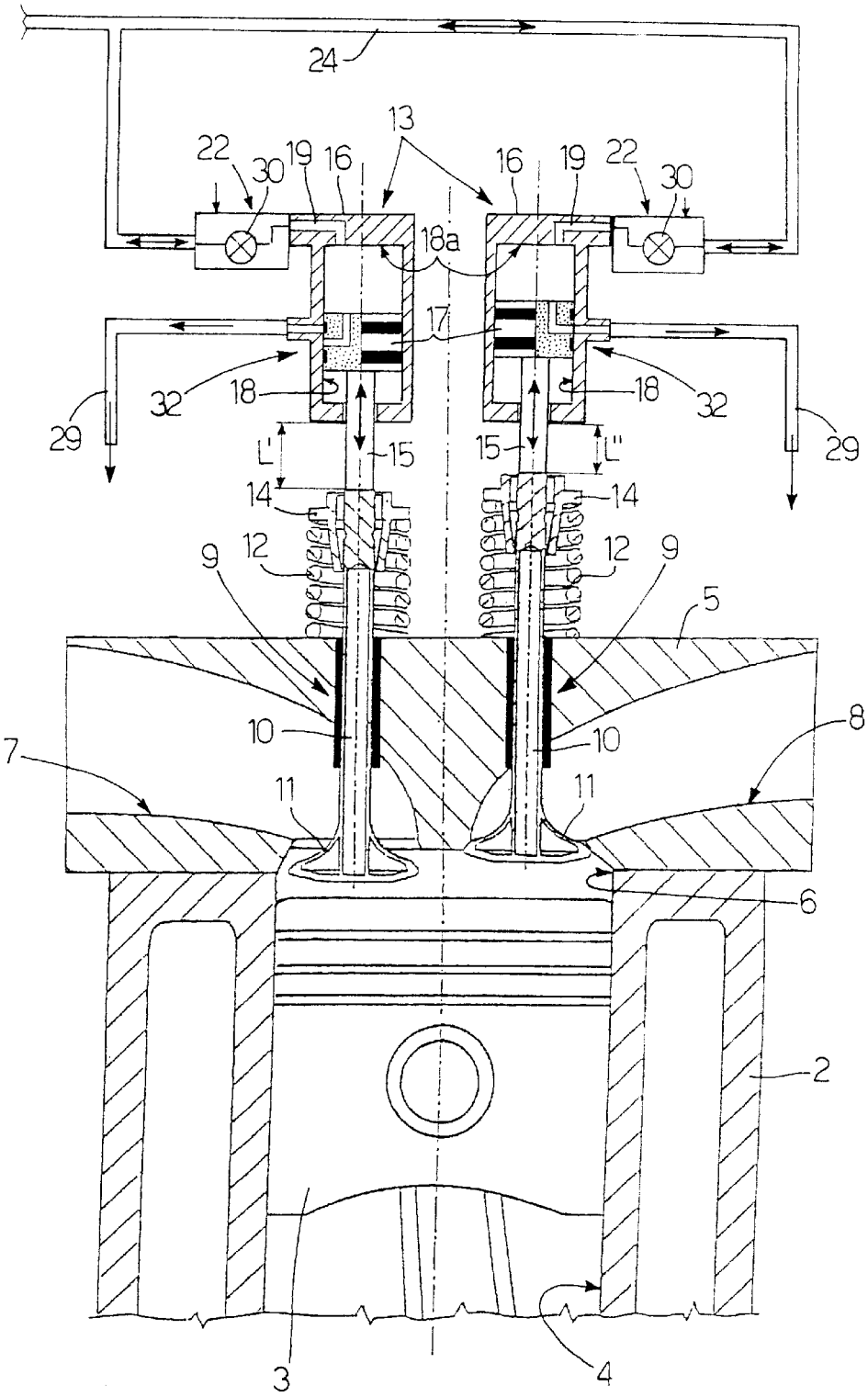
FIG. 2 is a cross-section through a variant of a component of the hydraulic circuit of the internal combustion engine shown in FIG. 1.

In particular, with reference to the variant shown in FIG. 2, the hydraulic distributors 22 of the hydraulic circuit 20 do not comprise the exhaust electrovalve 31. In this case, the discharge of the part of the pressurised oil that the elastic member 12 has not been able to urge back into the delivery duct 24 and/or the collection tank 26 takes place by drawing through a slide valve 32 of known type, obtained directly in the hydraulic actuator 13. This slide valve 32 is in particular formed so that it can bring the variable-volume chamber 18*a* of the linear hydraulic actuator 13 directly into communication with the exhaust duct 29, when the piston 17 is passing through the final stage of the closing stroke of the valve 9.

What is claimed is:

1. An internal combustion engine for motor vehicles comprising:

at least one intake valve and/or exhaust valve moving axially between a closed position and a position of maximum opening; and means for moving, on command, at least one of the valves between the closed position and the position of maximum opening;

the valve movement means comprising:

an elastic member to maintain the at least one of the valves in the closed position;

a hydraulic actuator to selectively move the at least one of the valves from the closed position to the position of maximum opening by countering the action of the elastic member; and a hydraulic circuit to supply pressurized fluid to the hydraulic actuator, the hydraulic circuit comprising a delivery duct connected to the hydraulic actuator and pumping means for supplying the pressurized fluid from the hydraulic actuator to the delivery duct, where the pumping means comprises the elastic member and the hydraulic actuator.

2. The internal combustion engine of claim 1, where the hydraulic circuit further comprises a collection tank in which the fluid to be supplied to the hydraulic actuator is stored at ambient pressure and at least one electronically controlled hydraulic distributor to regulate the flow of pressurized fluid into and out of the hydraulic actuator, the hydraulic distributor being disposed between the hydraulic actuator and the delivery duct and being disposed between the hydraulic actuator and the collection tank.

3. The internal combustion engine of claim 2, further comprising an electronic control unit to drive the hydraulic actuator.

4. The internal combustion engine of claim 3, where the hydraulic distributor comprises a delivery electrovalve to selectively bring the hydraulic actuator into communication with the delivery duct, the electronic control unit keeping the delivery electrovalve open during an initial part of a closing stroke of the valve.

5. The internal combustion engine of claim 4, where the hydraulic distributor further comprises an exhaust electrovalve to selectively bring the hydraulic actuator into communication with the collection tank, the electronic control unit keeping the exhaust electrovalve open during a terminal part of the closing stroke of the valve, when the delivery electrovalve is closed.

* * * * *